United States Patent [19]

Smart

[11] Patent Number: 4,913,499

[45] Date of Patent: Apr. 3, 1990

[54] EQUIPMENT AND METHOD FOR MEASURING CONVERGENCE

[75] Inventor: Brian G. D. Smart, Stirlingshire, Scotland

[73] Assignee: Coal Industry (Patents) Limited, London, England

[21] Appl. No.: 271,642

[22] Filed: Nov. 16, 1988

[30] Foreign Application Priority Data

Dec. 17, 1987 [GB] United Kingdom ..... 8729482

[51] Int. Cl.[4] ..... E21D 15/40; G08B 21/00

[52] U.S. Cl. ..... 299/12; 33/1 H; 73/784; 405/302

[58] Field of Search ..... 73/784, 786; 340/686, 340/690; 91/170 MP; 299/1, 11, 12; 405/291, 292, 302; 33/1 H

[56] References Cited

U.S. PATENT DOCUMENTS

| | | | |
|---|---|---|---|
| 1,737,514 | 11/1929 | Nikolish | 340/690 X |
| 3,341,843 | 9/1967 | Wolsh | 73/784 X |
| 3,594,773 | 7/1971 | Conkle | 340/690 |
| 3,672,174 | 6/1972 | Von Hippel | 299/1 X |
| 4,514,905 | 5/1985 | Lutzens | 73/784 X |

FOREIGN PATENT DOCUMENTS

| | | | |
|---|---|---|---|
| 1129438 | 5/1962 | Fed. Rep. of Germany | 73/784 |
| 723128 | 3/1980 | U.S.S.R. | 33/1 H |
| 11916 | 5/1914 | United Kingdom | 73/784 |

*Primary Examiner*—Stephen J. Novosad
*Assistant Examiner*—David J. Bagnell
*Attorney, Agent, or Firm*—James Creighton Wray

[57] ABSTRACT

A transducer is placed in a telescopic strut and connected to a roof cam and a floor cam. The cams are pivoted to a roof support and a constant load is applied to the cams by a gas spring. As convergence takes place a transducer in the telescopic strut records the relative movement between the floor and roof and transmits this as an electrical signal for analysis.

18 Claims, 1 Drawing Sheet

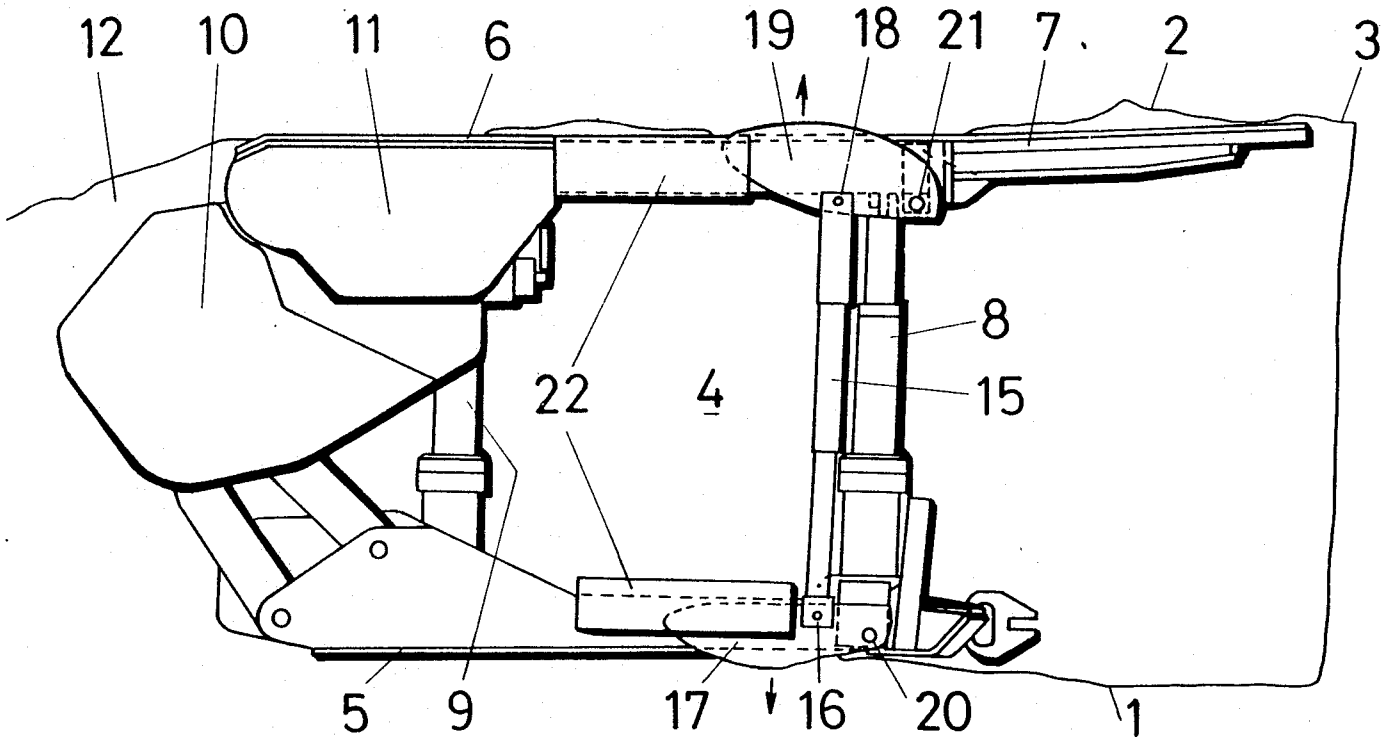
3
2
7
21
18
19
6
11
10
12
8
15
4
22
1
20
16
17
9
5

EQUIPMENT AND METHOD FOR MEASURING CONVERGENCE

BACKGROUND OF THE INVENTION

1. Field of the Invention

This invention relates to equipment and a method for measuring the convergence and distance between the floor and the roof of an excavated area, such as in a coal mine.

2. Description of the Related Art

In longwall mining situations it is a practice for extraction of a mineral such as coal to be taken from a seam and whether advance or retreat mining is being worked for the roof of the seam to be allowed to collapse behind the work area. At the face which is being worked, supports are positioned to enable the machinery cutting from the face to have a free run and the supports are advanced as the face advances.

While the collapse of the roof is normally a sudden affair behind the supports there is a natural convergence between roof and floor in the supported region. This effect, of course, varies depending on the material of the roof.

SUMMARY OF THE INVENTION

It is useful to be able to detect the degree of convergence between roof and floor and relate it to the pressures which are being developed by the supports. This is an object of the present invention to provide an equipment and a method whereby this can be reliably and safely done.

According to a first aspect of the present invention, equipment for measuring the convergence and distance between the floor and roof of an excavated area includes transducer means positioned between the floor and roof, cam means positioned at least at one end of the transducer means and adapted to engage the floor or roof and to maintain a contact therewith and spring means arranged to exert a constant load on the cam means.

The transducer means preferably includes a potentiometer arranged to be varied to give a varying electrical output dependant on the degree of convergence between the floor and roof.

The spring means is preferably a gas spring which is readily controllable to enable the constant load to be maintained. Alternatively, mechanical spring means may be used.

Preferably cam means are provided at either end of the transducer to engage both the roof and the floor. The cam means are preferably profiled with a smooth profile, although in certain instances it may be desirable to provide a stepped profile, particularly to the floor cam if this has to operate in a reverse direction.

The transducer means and the spring means may be contained within a telescopic strut housing, or the spring means may be mounted externally. The whole of the equipment may be positioned on a roof support and mounted for movement with the roof support. In such a condition, spacer means may be necessary to prevent any pinching of parts of the equipment by adjacent roof supports and preferably guards are also provided to protect the equipment.

In order that the invention may be readily understood, one example of equipment in accordance with the invention and using the method thereof will now be described with reference to the accompanying schematic drawing. The drawing shows the equipment in position on a roof support in a coal seam.

BRIEF DESCRIPTION OF THE DRAWING

The drawing shows a side elevation of a convergence measuring equipment mounted beside a front strut on a roof support within a seam.

DESCRIPTION OF THE PREFERRED EMBODIMENT

Referring now to the drawing, this shows a coal seam defined by a floor (1), a roof (2) and a face (3) of coal which is being worked by machinery (not shown). The roof (2) is supported by a conventional advancing roof support indicated generally at (4). This support comprises floor members (5) and roof members (6) with a forwardly extending roof canopy (7) over the front of the support. Forward hydraulically powered rams (8) and rear rams (9) extend between the members (5) and (6) and support the roof. The support (4) also has a rear hinged shield (10) and side shield (11) to protect the area of the support (4) from falling debris in the region (12) immediately behind the support where the roof looses its support and is converging with the floor (1). The equipment of the invention comprises a telescopic strut (15) which is secured by pivotal means (16) to a floor cam (17) and by a pivotal means (18) to a roof cam (19). The cams are connected in a pivotal manner at (20) and (21) respectively to the roof strut and floor strut of the support so that they may swivel under pressure from the telescopic strut (15) and be moved against the roof (2) and the floor (1).

The telescopic strut (15) contains within its housing a potentiometer constituting a transducer. Gas springs are mounted externally to force the cams against roof and floor respectively. Guards and spacers (22) are provided at both the top and the bottom of the support since modern shielded supports normally operate on a "skin for skin" basis with contact being maintained between adjacent support canopies with hydraulically powered side shields. It is necessary to modify the shields to allow the cams (17), (19) to be installed, and an opening must be maintained between the support canopy to allow the top cam (19) to contact the roof. This is achieved by deactivating the side shield and introducing the guards and spacers (22) in front of and behind the roof cam (19) so that the canopies are unable to come together and pinch the cam (19) and thus inhibit its free movement.

In use the equipment is fitted to the support and the telescopic strut (15) is loaded so that the floor cam (17) engages firmly with the floor (1) and the roof cam (19) engages firmly with the roof (2). The loading is set to a pre-determined level and the gas springs are adjusted so that in spite of variations in the loading exerted by the convergence of the roof (2) relative to the floor (1), which means telescoping of the strut (15), a constant pressure is maintained within the strut (15) on the two cams. As the face (3) advances through cutting of material from it the roof supports are also advanced and the cams (17), (19) follow the profile of the roof. If the roof is converging, then the strut (15) is compressed inside due to its telescopic nature and the transducer within it, in this example is a rotary potentiometer using a spring-loaded pull cord, is varied and an electrical signal derived from the potentiometer is correspondingly altered and fed to remote indicating equipment where the convergence can be scaled and measured.

It will be noted that the profile of the roof cam (19) is smooth and that its pivot (21) is located at one extreme end. This allows maximum movement of the cam (19) and all the irregularities in the roof are able to be followed correctly. The smooth surface profile of the cam allows for the situation where the support (4) not only moves forwards relative to the face but also as occasionally happens has to be moved in the reverse direction.

It will be seen that the floor cam (17) is given a slightly different profile than the roof cam (19). This is to enable it to mount more easily irregularities in the floor caused by the cutting operation.

The cams are shown in this example as fitted in line with the forward rams (8) of the support (4). They can equally well also be fitted to the rear rams (9) so that comparative convergence data can be obtained from both forward and rear rams wherever convergence is measured, a theoretical relationship is used to determine the pressure increase that should arise in the hydraulic rams if they absorbed all that convergence. Comparison between that theoretical pressure increase and the actual pressure increase, measured with a separate pressure transducer enables deductions to be made regarding support system performance.

The equipment and method of the invention enable a constant monitoring and swift read out to be obtained of the convergence so that mine operatives can constantly be informed of the condition in the excavated area. The invention also enables a constant measurement of distance between roof and floor to be made.

It will be appreciated that the equipment can be varied without departing from the scope of the invention. For example, the gas spring may conveniently be replaced by a mechanical spring and that if necessary only one of the cams need be provided. If only one cam is provided the surface which is not being ridden by the cam would only be detected by the relevant support member to which the telescopic member (15) is connected.

I claim:

1. Equipment for measuring the convergence and distance between floor and roof of an excavated area including transducer means positioned between the floor and roof, cam means positioned at least at one end of the transducer means and adapted to engage the floor or roof and to maintain contact therewith and spring means arranged to exert a constant load on the cam means.

2. Equipment as claimed in claim 1 in which the transducer means includes a potentiometer arranged to be varied to give a variation of an electrical signal dependent on the degree of convergence monitored.

3. Equipment as claimed in claim 1 wherein the spring means is a gas spring.

4. Equipment as claimed in claim 1 wherein the cam means include plural means positioned to engage both the roof and the floor of the excavated area.

5. Equipment as claimed in claim 1 wherein the cam means has a smooth profiled area to cooperate with an adjacent surface.

6. Equipment as claimed in claim 1 and including cam means on at least the lower end of the transducer means, the said cam means having a stepped profile adapted to engage the floor of the excavated area.

7. Equipment as claimed in claim 1 and including a telescopic strut connecting with the cam means and containing the transducer means and the spring means.

8. Equipment as claimed in claim 1 and including pivotal fixing means for fixing the cam means to a roof support.

9. Equipment as claimed in claim 1 and including guard and spacer means connected to a roof support to protect the equipment.

10. Equipment as claimed in claim 1 and including pivot means connected between the cam means and the transducer means for allowing the cam means to rotate on the transducer means.

11. Equipment as claimed in claim 10 and wherein the pivot means are horizontal pivot means.

12. Equipment as claimed in claim 11 and wherein the cam means and pivot means are positioned at opposite ends of the transducer means.

13. Equipment as claimed in claim 12 and including roof and floor support members, and second pivot means connecting the cam means to the support members.

14. Equipment as claimed in claim 10 and including at least one roof or floor support member and second pivot means connected to the support member and to the cam means.

15. Equipment as claimed in claim 14 and wherein the pivot means are horizontal pivot means.

16. Equipment as claimed in claim 15 and wherein the cam means and pivot means are positioned at opposite ends of the transducer means.

17. Equipment as claimed in claim 16 and including roof and floor support members, and second pivot means connecting the cam means to the support members.

18. A method of measuring convergence in a mined area comprising placing a transducer in a telescopic element on a pivoted cam between the roof and the floor of the area, loading the transducer with a constant pressure between the roof and the floor, monitoring the output of the transducer as convergence occurs and deriving an electrical signal proportional to the convergence.

* * * * *